United States Patent [19]

Szilagyi

[11] 4,425,856

[45] Jan. 17, 1984

[54] PROCESS FOR THE TREATMENT OF AQUEOUS EFFLUENTS CONTAINING ORGANIC SUBSTANCES AND INORGANIC SALTS AND APPARATUS FOR USE THEREIN

[75] Inventor: Ferenc Szilagyi, Antony, France

[73] Assignee: Rhone- Poulenc Industries, Paris Cedex, France

[21] Appl. No.: 272,280

[22] Filed: Jun. 10, 1981

[30] Foreign Application Priority Data

Jun. 13, 1980 [FR] France ..... 80 13165

[51] Int. Cl.[3] ..... F23G 5/00

[52] U.S. Cl. ..... 110/346; 110/238; 431/175; 431/285

[58] Field of Search ..... 110/238, 346; 431/8, 431/9, 173, 174, 175, 283, 285

[56] References Cited

U.S. PATENT DOCUMENTS

| | | | |
|---|---|---|---|
| 3,822,653 | 7/1974 | Ghelfi | 110/238 |
| 4,291,634 | 9/1981 | Bergsten et al. | 110/238 |

FOREIGN PATENT DOCUMENTS

| | | | |
|---|---|---|---|
| 2223631 | 5/1972 | Fed. Rep. of Germany | 431/175 |
| 52-25478 | 2/1977 | Japan | 110/238 |

*Primary Examiner*—Edward G. Favors
*Assistant Examiner*—Steven E. Warner
*Attorney, Agent, or Firm*—Stevens, Davis, Miller & Mosher

[57] ABSTRACT

Aqueous effluents containing organic substances and possibly inorganic salts, are burnt in an incinerator in which the injector for the said effluent is so arranged in relation to the burners that combustion is improved and molten salts are not deposited on the wall of the furnace.

2 Claims, 2 Drawing Figures

Figure 1:
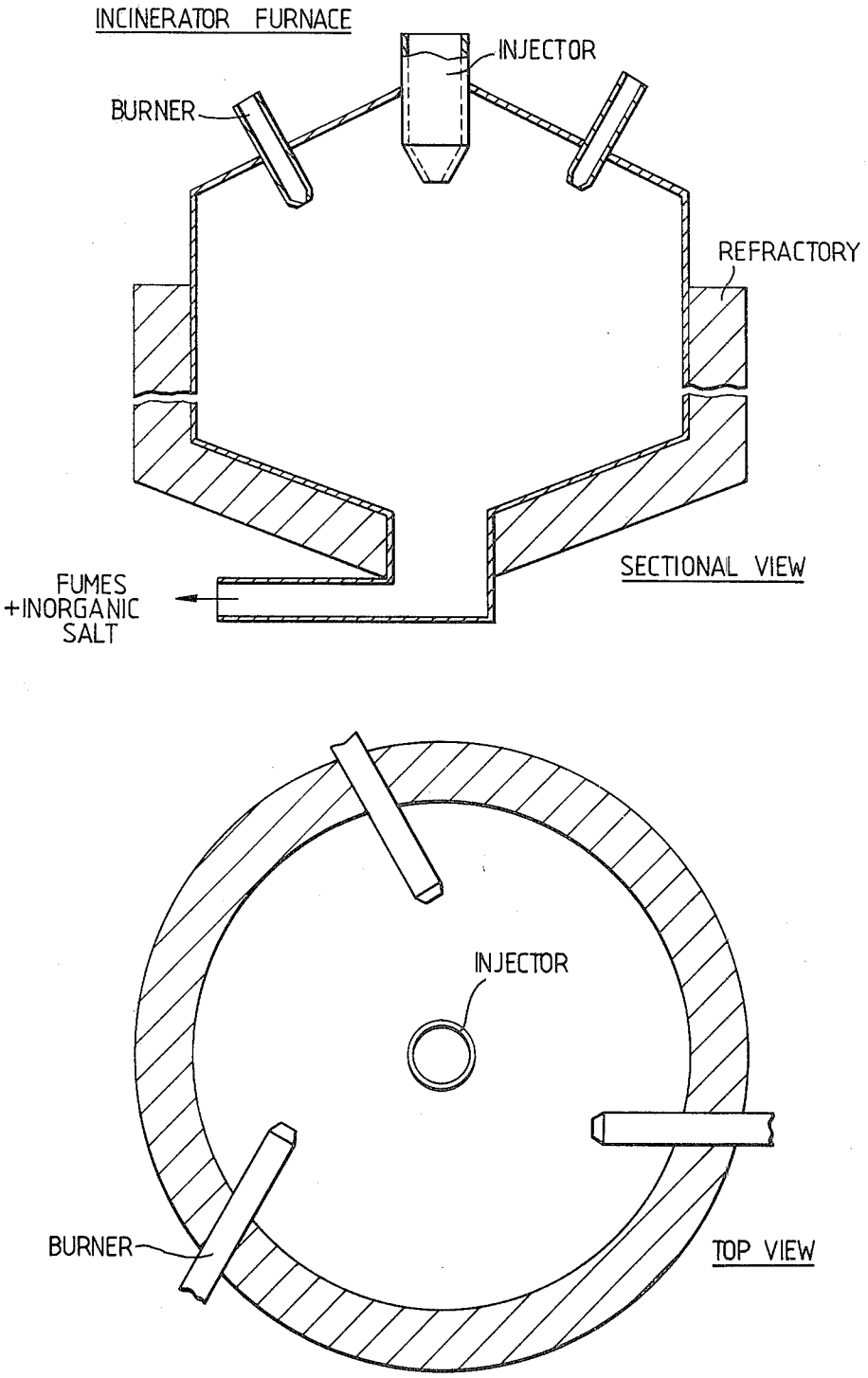

PROCESS FOR THE TREATMENT OF AQUEOUS EFFLUENTS CONTAINING ORGANIC SUBSTANCES AND INORGANIC SALTS AND APPARATUS FOR USE THEREIN

DESCRIPTION

The present invention relates to the treatment of aqueous effluents containing, in solution, organic substances and possibly inorganic salts, in order to remove the organic substances and, if appropriate, to recover the inorganic salts with a quality sufficient to enable them to be utilised and marketed.

More particularly, the invention relates to a process for the treatment of aqueous effluents containing a high proportion of organic substances (of the order of 10%) and of inorganic salts (generally between 15 and 30%). The treatment of such effluents is the more difficult, the higher is the content of inorganic salts and the greater the stability of the residual organic substances.

It is known to subject aqueous effluents of the above type to combustion in an incinerator consisting of a vertical cylindrical furnace, in the upper part of which is located the orifice of a liquid or gaseous fuel burner, and in the walls of which, towards the upper end, are located the orifices of the injectors which bring the effluent to be treated to the level of the flame.

Furnaces equipped with mixed burners formed by three concentric tubes, through which the polluted water, the fuel and the combustion air arrive, are also used.

Incinerator furnaces of this type do not always operate satisfactorily and the salts recovered are greyish and unmarketable. This poor efficiency is due to the fact that, on account of the design of the furnace, the burning temperature cannot be increased without risk of blocking. Thus, when using an aqueous effluent containing sodium sulphate as an inorganic salt, a temperature of the order of 850° C., which is necessary for destroying virtually all the organic substances, cannot be reached because, at this temperature, the salt melts and a kind of meringue forms on the wall which accumulates and gradually leads to the blocking of the furnace. To avoid this disadvantage, it is possible to envisage combustion at a lower temperature, that is to say in the region of 720° C. However, at this temperature, the combustion of the organic components of the effluent is incomplete and the salt recovered is contaminated by particles of soot, which render it unusable. Furthermore, on account of the spraying angle of each injector, part of the sprayed effluent falls directly on the wall of the furnace, which causes and assists the deposition of the salt.

It has now been found that the combustion can be substantially improved and that the deposition of the molten salt on the wall of the furnace can be considerably reduced by modifying the injection system so as to increase the turbulence and assist the contact of the hot flow with the effluent to be treated.

According to the present invention, the burning of the aqueous effluents is carried out in an incinerator comprising a vertical cylindrical furnace at the top of which the said effluent is sprayed by an injector, in the presence of an excess of air used as the supporter of combustion, liquid or gaseous fuel burners being located towards the upper part of the furnace, which is preferably conical, arranged almost tangentially to the perimeter of the furnace and orientated towards the base of the furnace, in order to create a turbulence which entrains any salt present towards the centre and prevents its deposition on the walls of the furnace, the burners being arranged symmetrically in the upper part of the furnace so that the projection of their orifices onto a plane perpendicular to the axis of the furnace is located inside a ring, the radius of which is between the radius and half the radius of the furnace, and being orientated in a horizontal plane and in a vertical plane, the said orientation being defined by the dihedral angle formed by the vertical half-plane passing through the axis of the burner and by the vertical half-plane passing through the axis of the furnace and the orifice of the burner, this angle being between 120° and 160°, and the extension of the axis of the burner being tangential to an imaginary vertical cylinder, the radius of which is at least 0.35 times the radius of the furnace, and by the angle of inclination of the burner towards the bottom and at the base of which furnace a pressure reduction is created through the discharge orifice for the fumes and any salt formed, and any salt obtained is optionally recovered. The angle of inclination of the burner towards the bottom of the furnace is generally between 10° and 60°.

The end of the central injector must be located so that the sprayed jet falls directly in the flame; its position relative to the burners is thus defined by the spraying angle. The effluent undergoes combustion in the zone delimited by the end of the injector and of the burners, and it then necessarily passes through the flame, which constitutes a superheated zone in which the combustion proceeds to completion. Furthermore, by orientating the burners as indicated above, the turbulence created forces the combustion products towards the centre of the furnace, thus preventing the troublesome deposition of the salt on the wall. By using a system of this type, the combustion temperature can be substantially higher than the melting point of the salt.

To assist the discharge of the fumes which entrain the salt, a pressure reduction is created inside the furnace, the discharge orifice being located in the bottom part of the furnace.

The injector which brings the aqueous effluent to be burned can consist of two concentric tubes. The aqueous effluent circulates in the central tube, and air, which may be compressed, circulates in the external annular tube; the effluent is thus sprayed through the orifice of the injector.

The burners located in the upper part of the furnace, towards the periphery, are of the conventional type and they can be fed with liquid or gaseous fuel. In general, three burners, arranged in a star, at 120°, and orientated towards the base of the furnace, are used.

An incinerator used for carrying out the present invention is particularly advantageous for burning aqueous effluents containing organic substances having a high heat stability, and more particularly aqueous effluents originating from the preparation of methionine. The mother liquors originating from the manufacture of methionine contain an average of 20% by weight of sodium sulphate and 10% by weight of organic substances.

With an effluent of this type, the ignition temperature is of the order of 700° C., but the optimum combustion temperature is in the region of 900° C., a higher temperature bringing no substantial improvement to the desired result.

The aqueous effluent must be sprayed, if appropriate under pressure (for example 10 bars), in the presence of air in an excess of the order of at least 30%.

The residence time in the incinerator, which is defined by the ratio of the volume of the combustion zone to the flow rate of the air, is of the order of 3 seconds, a longer residence time bringing no substantial improvement to the result and a shorter residence time, of the order of 1.5 seconds, leading to the production of a salt of inadequate quality for most purposes.

It is particularly advantageous to introduce all the combustion air at the top of the combustion chamber, so as to improve the burning efficiency.

The fumes are cooled by the steam produced and the cooling is improved by the addition of air cooling, in order to bring about a further reduction in the proportion of unburned organic substances.

Figure 2:
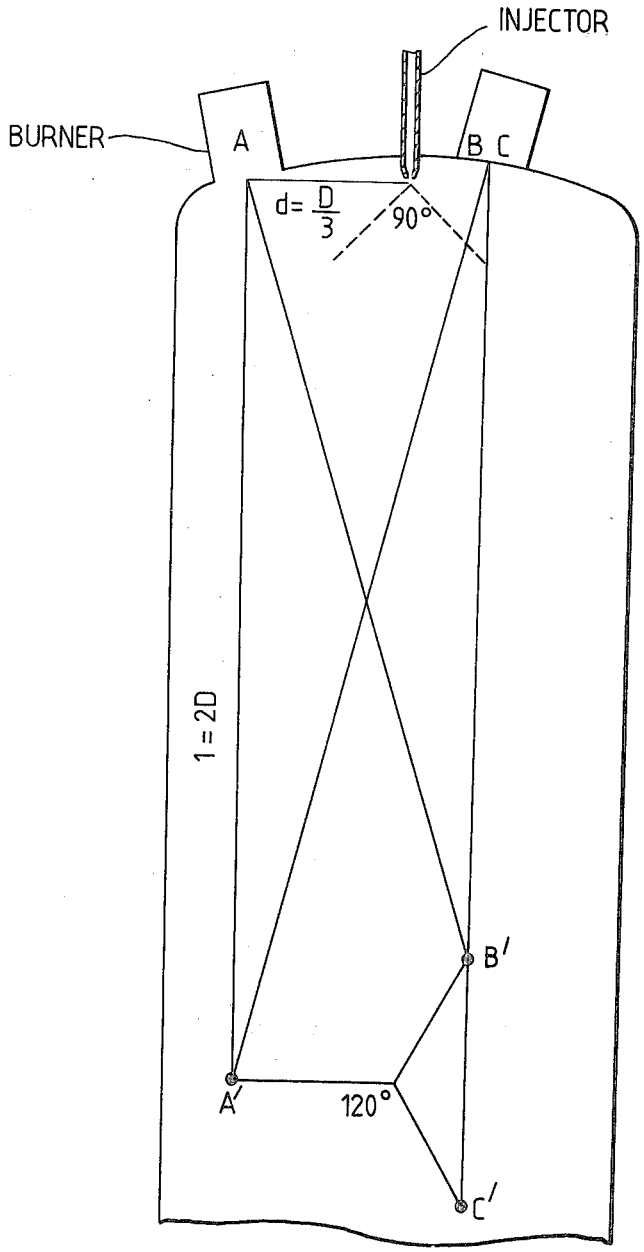

FIGS. 1 and 2 of the accompanying drawings show the construction of an incinerator according to the present invention.

By way of illustration, an incinerator according to the present invention can have a diameter of 3 to 4 m for a height of between 10 and 15 m. When equipped with a ring of 3 burners having a total heating capacity of 10,000 therms/hour, located 120° apart, orientated so that the axis of one burner, the end of which is located at a distance from the axis of the furnace which is of the order of a third of its diameter, is directed towards the projection of the end of the adjacent burner onto a plane, perpendicular to the axis of the furnace, located at a distance from the end of the burners which is approximately twice the diameter of the furnace, and fed with liquid or gaseous fuel, the aqueous effluent being sprayed into the flame at an angle of the order of 90°, an incinerator of this type makes it possible to burn 3 to 6 tonnes of aqueous effluents per hour.

The invention includes within its scope an incinerator for carrying out the process described above comprising a vertical cylindrical furnace, provided at the top with an injector for spraying effluent in the presence of an excess of air used as the supporter of combustion, liquid or gaseous fuel burners located towards the upper part of the furnace, arranged almost tangentially to the perimeter of the furnace and orientated towards the base of the furnace, in order to create in use of the said furnace a turbulence which entrains any salt towards the centre and prevents its deposition on the walls of the furnace, the burners being arranged symmetrically in the upper part of the furnace so that the projection of their orifices onto a plane perpendicular to the axis of the furnace is located inside a ring, the radius of which is between the radius and half the radius of the furnace, and being orientated in a horizontal plane and in a vertical plane, the said orientation being defined by the dihedral angle formed by the vertical half-plane passing through the axis of the burner and by the vertical half-plane passing through the axis of the furnace and the orifice of the burner, this angle being between 120° and 160°, and the extension of the axis of the burner being tangential to an imaginary vertical cylinder, the radius of which is at least 0.35 times the radius of the furnace, and by the angle of inclination of the burner towards the bottom.

In FIG. 2, the points A, B and C represent the orifices of the burners and the points A′, B′ and C′ represent the projections of the orifices of the burners onto a plane perpendicular to the axis of the furnace of diameter D. The point of intersection of the axis of the burner A is the point B′, that of B is the point C′ and that of C is the point A′.

I claim:

1. A process for the treatment of aqueous effluents containing organic waste and possibly inorganic salts, which comprises burning the said effluent in an incinerator comprising a vertical cylindrical furnace, by spraying the said effluent by an injector, using an excess of air as the supporter of combustion, the sprayed effluent jet passing through the flames of liquid or gaseous fuel burners located towards the upper part of the furnace, arranging the said burners almost tangentially to the perimeter of the furnace and orientated towards the base of the furnace, creating a turbulence which entrains any salt present towards the center and preventing its deposition on the walls of the furnace, the burners being arranged symmetrically in the upper part of the furnace so that the projection of their orifices onto a plane perpendicular to the axis of the furnace is located inside a ring, the radius of which is between the radius and half the radius of the furnace, and being orientated in a horizontal plane and in a vertical plane, defining the said orientation by the dihedral angle formed by the vertical half-plane passing through the axis of the burner and by the vertical half-plane passing through the axis of the furnace and the orifice of the burner, this angle being between 120° and 160°, and the extension of the axis of the burner being tangential to an imaginary vertical cylinder, the radius of which is at least 0.35 times the radius of the furnace, and by the angle of inclination of the burner towards the bottom of the furnace, the said angle of inclination being between 10° and 60°, and creating a pressure reduction at the base of the furnace through the discharge orifice for the fumes and any salt formed, and optionally recovering any salt obtained.

2. An incinerator comprising a vertical cylindrical furnace, provided at the top with injector means for spraying effluent in the presence of an excess of air used as the supporter of combustion, liquid or gaseous fuel burners located towards the upper part of the furnace, located so that effluent sprayed by the said injector passes through flames of said burners, and arranged almost tangentially to the perimeter of the furnace and orientated towards the base of the furnace, in order to create in use of the said furnace a turbulence which entrains any salt towards the center and prevents its deposition on the walls of the furnace, the burners arranged symmetrically in the upper part of the furnace so that the projection of their orifices onto a plane perpendicular to the axis of the furnace is located inside a ring, the radius of which is between the radius and half the radius of the furnace, and orientated in a horizontal plane and in a vertical plane, the said orientation defined by the dihedral angle formed by the vertical half-plane passing through the axis of the burner and by the vertical half-plane passing through the axis of the furnace and the orifice of the burner, this angle being between 120° and 160°, and the extension of the axis of the burner being tangential to an imaginary vertical cylinder, the radius of which is at least 0.35 times the radius of the furnace, and by the angle of inclination of the burner towards the bottom, the said angle of inclination being between 10° and 60°.

* * * * *